US005100304A

United States Patent [19]

Osada et al.

[11] Patent Number: 5,100,304

[45] Date of Patent: Mar. 31, 1992

[54] SOLENOID-OPERATED RECIPROCATING PUMP

[75] Inventors: Toshio Osada; Tamotsu Mori; Masaaki Tanabe, all of Tokyo, Japan

[73] Assignee: Nitto Kohki Co., Ltd., Tokyo, Japan

[21] Appl. No.: 675,274

[22] Filed: Mar. 26, 1991

[30] Foreign Application Priority Data

Sep. 5, 1990 [JP] Japan ..... 2-48401[U]

[51] Int. Cl.[5] ..... F04C 17/04; F04C 35/04; F04C 35/04; F16C 27/04

[52] U.S. Cl. ..... 417/417; 417/418; 384/611

[58] Field of Search ..... 417/417, 418; 384/609, 384/611, 453, 454, 578

[56] References Cited

U.S. PATENT DOCUMENTS

| | | | |
|---|---|---|---|
| 592,502 | 10/1897 | Thompson | 384/611 |
| 1,491,992 | 4/1924 | McCuen | 384/454 |
| 4,261,689 | 4/1981 | Takahashi | 417/417 |
| 4,854,833 | 8/1989 | Kikuchi et al. | 417/417 |
| 4,966,533 | 10/1990 | Uchida et al. | 417/417 |

OTHER PUBLICATIONS

Patent Appln. Publn. Kokoku No. 57-51551; published Nov. 2, 1982; Appln. No. 50-122942; filed Oct. 14, 1975: S. Takahashi.

U.M. Appln. Publn. Kokoku No. 62-18712; published May 13, 1987; Appln. No. 54-15617; filed Feb. 8, 1979: S. Takahashi.

U.M. Appln. Publn. Kokoku No. 55-45094; published Oct. 23, 1980; Appln. No. 48-145247; filed Oct. 20, 1973: T. Mogaki.

*Primary Examiner*—Richard A. Bertsch
*Assistant Examiner*—Alfred Basichas
*Attorney, Agent, or Firm*—Jones, Tullar & Cooper

[57] ABSTRACT

A solenoid-operated reciprocating pump includes a casing having a cylinder with a central axis. A main shaft is disposed in and secured at one end to the casing in alignment with the central axis of the cylinder. A piston having a piston head is slidably fitted over the main shaft such that the piston head is disposed within the cylinder for axial motion. A coil spring extends between the piston and casing to bias the piston in a first axial direction and an armature radially extends from the outer periphery of the piston for interaction with an electromagnet disposed around the longitudinal periphery of the piston. The electromagnet attracts the armature and hence the piston in a second axial direction opposite from the first direction. On end of the coil spring is fixed to one of the piston or the casing and the other end of the spring is rotatably supported on the other of the piston or the casing by a spring retainer seated on a plurality of spherical balls which are in turn seated on said other of the piston or the casing means. The balls are positioned at equal distances radially from the central axis of the coil spring and at equal circumferential spacings around the axis.

3 Claims, 2 Drawing Sheets

SOLENOID-OPERATED RECIPROCATING PUMP

TECHNICAL FIELD

This invention relates generally to a solenoid-operated reciprocating pump, and particularly to a solenoid-operated reciprocating pump in which a piston for drawing in and discharging fluid is slidably fitted over a cantilever shaft mounted in a casing of the pump.

BACKGROUND ART

Japanese Patent Application Publication Kokoku No 57-51551 discloses a pump of the type as will be called solenoid-operated reciprocating pump hereinafter in which a piston having a piston head slidably disposed in a cylinder is biased in one direction by a spring and is periodically attracted in the other opposite direction by means of an electromagnet including a plurality of magnetic poles located around the outer periphery of the piston to draw in and discharge fluid.

The piston of the solenoid-operated reciprocating pump as disclosed in said Patent Application Publication is supported for sliding movements axially of the cylinder by disposing the piston head within the cylinder and inserting the end of the piston opposite from the piston head in a tubular sleeve similar to the cylinder.

However, in such arrangement in which the piston is supported by the peripheries thereof at its fore and rear ends, that is, the periphery of the piston head and the periphery at the end of the piston opposite from the piston head, an increase in the diameter of the piston would necessarily require that both the periphery of the piston head and the periphery at the end of the piston opposite from the piston head be increased in diameter, resulting in an increase in the frictional drag of the piston, which will in turn reduce the discharging or suctioning efficiency of the solenoid-operated reciprocating pump.

In an attempt to overcome such problem, Japanese Utility Model Application Publication Kokoku No. 62-18712 discloses a solenoid-operated reciprocating pump in which a cantilever shaft is mounted in the pump casing and a piston having a bore the inner diameter of which is substantially equal to the outer diameter of said shaft is supported by inserting the shaft in said bore of the piston.

In said Utility Model the piston-returning spring is in the form of a coil spring and disposed between and secured to the piston and the casing where the cantilever shaft is fixed (see FIG. 1 of the Publication).

In this arrangement in which the piston has a bore formed extending therethrough and is supported by inserting the shaft in said bore, an increase in diameter of the piston would not necessarily require increasing the diameter of the bore correspondingly, not resulting in an excessive increase in the frictional drag of the piston.

The construction of the pump of the aforesaid Utility Model Application Publication Kokoku No. 62-18712 has, however, the disadvantage that as the piston is attracted by the electromagnet, the armature of the piston can be drawn farther toward those on either one side of a plurality of magnetic poles disposed around the piston than those on the other side, causing a circumferentially uneven wear on the piston, thereby reducing the useful life of the piston.

In order to resolve this disadvantage, Japanese Utility Model Application Publication Kokoku No. 55-45094 proposes a solenoid-operated reciprocating pump where a coil spring is rotatably supported at its one end against the pump casing by means of a spring retainer seated on a spherical ball while the spring is fixed at the other end to a piston, whereby the spring causes the piston to rotate gradually by torsional forces generated as the spring returns to its relaxed state from its compressed position to thereby prevent the piston from suffering an uneven wear.

Nevertheless, the coil spring is supported on the spherical surface, that is, in a one-point contact, so that the coil spring tends to lean from the central axis toward one or other side and flexed to a slight extent, which will in turn produce an undesirable biasing force toward one or other side of the cylinder on the piston.

SUMMARY OF INVENTION

The present invention contemplates to overcome the drawbacks with the prior art as described above.

It is, accordingly, an object of the invention to provide a solenoid-operated reciprocating pump of the type described in which an increase in diameter of the piston would not lead to an excessive increase in frictional drag of the piston so that a circumferentially uneven wear may be minimized.

Briefly, the present invention provides a solenoid-operated reciprocating pump characterized by disposing a piston-returning coil spring between the piston and the pump casing and rotatably supporting one end of a piston-returning coil spring on either the pump casing or the piston by means of a spring retainer seated on a plurality of spherical balls positioned at equal distances radially from the central axis of the coil spring.

BRIEF DESCRIPTION OF THE DRAWINGS

These and other more detailed and specific objects and features of the present invention will be more fully disclosed in the following specification with reference to the accompanying drawings, in which.

DETAILED DESCRIPTION OF THE PREFERRED EMBODIMENTS

Figure 1:
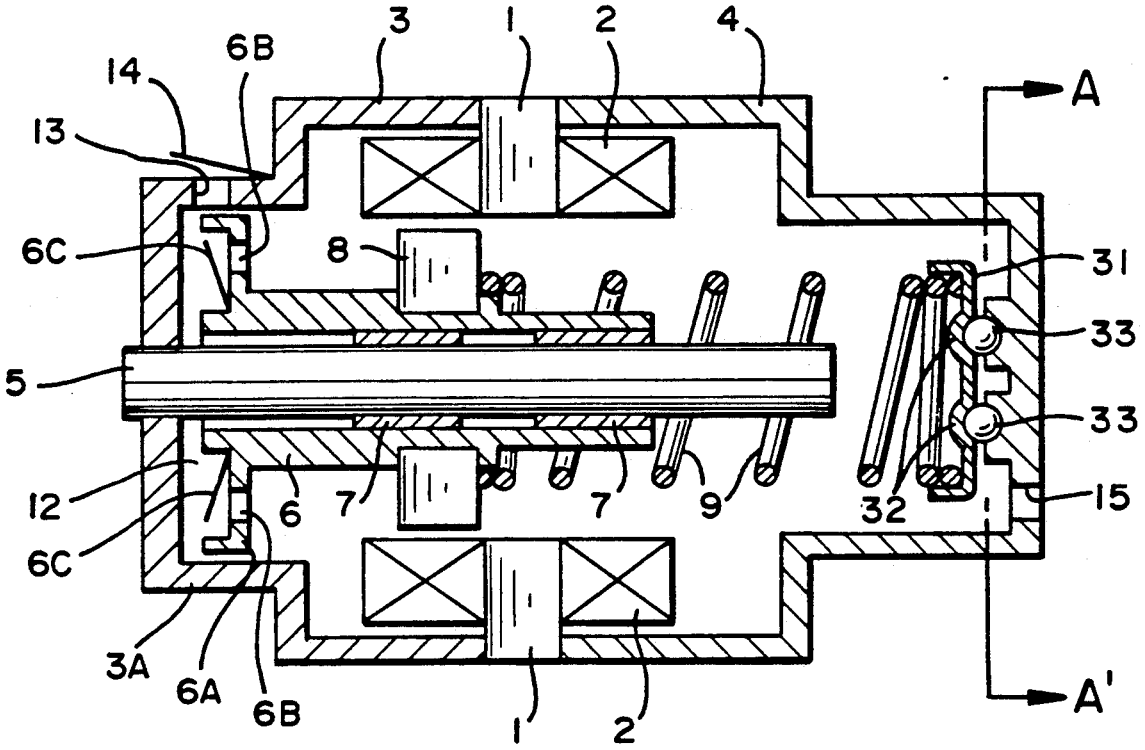
FIG. 1 is a longitudinal cross-sectional view of a first embodiment of the present invention.

Referring to FIG. 1, a solenoid-operated reciprocating pump according to a first embodiment of the present invention is shown comprising a casing means composed of a front casing 3 including a cylinder 3A and a rear casing 4. A plurality of magnetic poles 1 each having a magnetic coil 2 wrapped therearound are disposed around the longitudinal periphery of a piston 6 as will be described below. The magnetic pole 1 and the associated magnetic coil 2 constitute an electromagnet. The magnetic poles 1 are fastened to the casing means as by being clamped between the front and rear casings.

A main shaft 5 is staked at one end to the end wall of cylinder 3A integrally formed with the front casing 3 in a cantilevered manner with the axis of the shaft in axial alignment with the central axis of the cylinder.

The piston 6 having a piston head 6A at its one end is slidably fitted over the main shaft 5 such that the piston head is disposed within the cylinder 3A for axial motion. Bearing means 7 surrounds the main shaft 5 and is secured to either the outer periphery of the main shaft or the inner wall of the piston 6 for rotatably and axially slidably supporting the piston. It is to be noted that the bearing 7 should be positioned adjacent the end of the piston opposite from the piston head 6A, as the end of the piston where the piston head is provided is supported by the piston head in contact with the inner wall of the cylinder 3A.

The piston head 6A is generally cylindrical and cooperates with the cylinder 3A to define a pressure chamber 12. The piston head 6A is provided with an inlet port 6B and an associated suction valve 6C for introducing fluid into the pressure chamber 12 while the cylinder 3A is provided with an outlet port 12 and an associated discharge valve 14 for discharging fluid from the pressure chamber, in response to the reciprocating movements of the piston.

An armature 8 is secured to and radially extending from the outer periphery of the piston 6.

A compression coil spring 9 is provided extending between the piston and casing 4 coaxially therewith to bias the piston in one axial direction toward the end wall of the cylinder 3A. One end of the coil spring adjacent the piston 6 is fixed to the piston while the other end of the coil spring adjacent the rear casing 4 is fixed to a spring retainer 31 which is rotatably supported on the end wall of the rear casing by means of a plurality of spherical balls 33 seated in recesses formed in the spring retainer. The balls are positioned at equal distances radially from the central axis of the coil spring 9 and preferably at equal circumferential spacings around the axis. The spring retainer 31 and balls 33 thus constitute a thrust bearing for the coil spring and hence the piston 6.

The rear casing 4 is formed with a fluid intake port 15.

With the construction of the pump according to the first embodiment of the invention as described hereinabove, when electric current is applied to the coil 2, the armature 8 is attracted axially toward the poles 1 against the biasing force of the coil spring 9 to the piston and piston head 6A to thereby expand the volume of the pressure chamber 12.

Thus, with half-wave alternating current, for example, applied to the coil 2, the piston 6 is repeatedly reciprocated so that fluid is introduced into the pressure chamber 12 through the inlet port 6B and suction valve 6C and discharged form the pressure chamber through the outlet port 13 and discharge valve 14. It is through the intake port 15 that the fluid is introduced into the casings 3, 4.

The principle on which the piston 6 is attracted by the electromagnets is the same as with the solenoid-operated reciprocating pump disclosed in the aforesaid Patent and Utility Model Application Publications.

The opposite ends of the coil spring 9 tend to be rotated relative to each other when the coil spring is compressed and expanded. In other words, the coil spring is compressed and expanded while it is being twisted.

This twisting produces approximately equal torsional forces at the opposite ends of the coil spring. The piston 6 and spring retainer 31 are caused to gradually rotate during the reciprocating movements of the piston as the piston is supported rotatably on the main shaft 5 and cylinder 3A by the bearing means 7 and piston head 6A while the coil spring 9 is mounted rotatably to the rear casing 4 by the spring retainer 31 and spherical balls 33.

With this construction, even if the armature 8 should be drawn farther toward those on either one side of a plurality of magnetic poles 1 disposed around the piston than those on the other side, the rotation of the piston would prevent the sliding portions of the piston, that is, the bearing means 7 and the piston head 6A from being subjected to a circumferentially uneven wear. Instead, should any wear be caused, it would be a circumferentially uniform wear. The useful life of the piston 6 and hence the whole solenoid-operated reciprocating pump is substantially extended.

It is also to be noted that the spring retainer 31 is supported perpendicularly to the central axis of the coils 2 by the plurality of spherical balls 33, so that the coil spring is prevented from flexing away from its central axis and exerting radial biasing forces on the piston.

Figure 2:
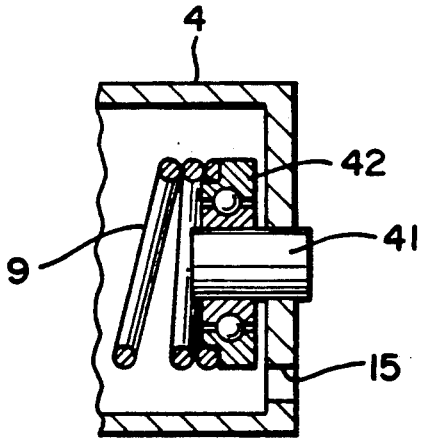
FIG. 2 is a cross-sectional view of a portion of a second embodiment of the invention.

FIG. 2 illustrates the end portion of the compression coil spring 9 adjacent the rear casing 4 according to a second embodiment of the invention partly in cross-section. In FIG. 2, like parts are indicated by the same reference numbers as in FIG. 1.

According to the second embodiment, a radial bearing means 42 is provided at the rear end of the compression coil spring 9 adjacent the rear casing 4 in place of the thrust bearing means 31, 33 in the first embodiment shown in FIG. 1. The radial bearing means 42 comprises an outer race fixed to the rear end of the coil spring and an inner race secured to a stud shaft 41 staked to the end wall of the rear casing 4.

This arrangement according to the second embodiment may be employed in applications where the compression coil spring has a relatively small spring force, and hence there are relatively small thrust forces exerted on the radial bearing means by the spring.

Figure 3:
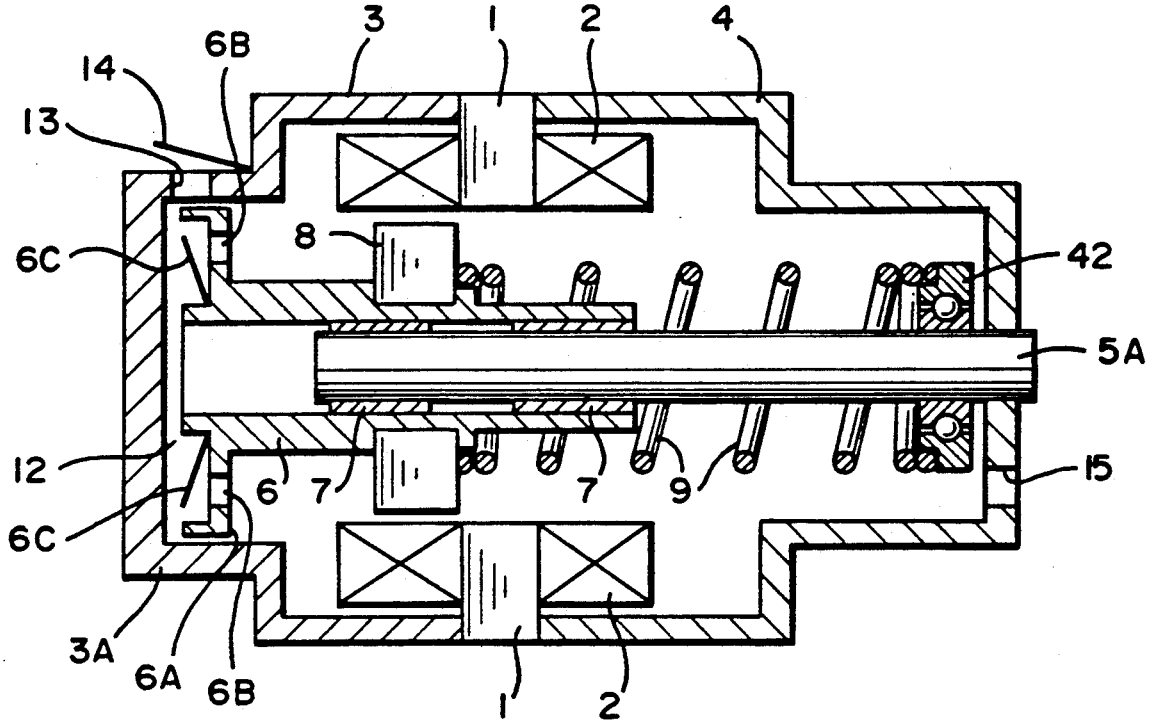
FIG. 3 is a longitudinal cross-sectional view of a third embodiment of the invention.
Figure 4:
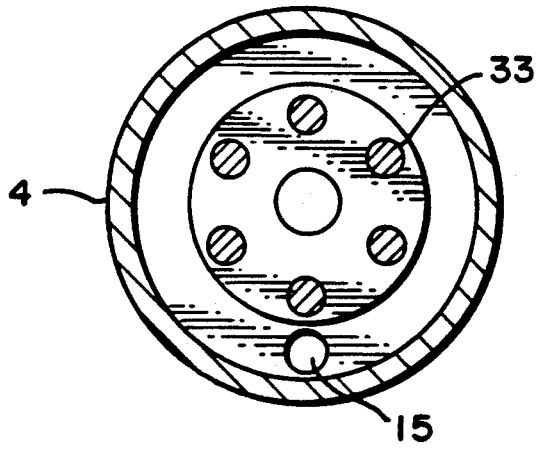
FIG. 4 is a cross-sectional view taken along the line A—A in FIG. 1.

FIG. 3 is a cross-sectional view of a third embodiment of the invention in which like parts are indicated by the same reference numbers as in FIG. 1 and FIG. 4.

The third embodiment is similar to the second embodiment in that a radial bearing means 42 is provided at the rear end of the compression coil spring 9 adjacent the rear casing 4 but different from the second embodiment in that a main shaft 5A slidably and rotatably supporting the piston 6 is staked to the rear casing 4 and that the inner race of the radial bearing means 42 is secured to the end of the main shaft 5A adjacent the rear casing 4.

Such arrangement in which the main shaft is staked to the rear casing 4 may be used in the embodiment of FIG. 1 where the thrust bearing is used.

While the end of the coil spring 9 adjacent the piston 6 is illustrated as secured to the piston with the end of the spring adjacent the rear casing 4 rotatably mounted to the rear casing in the foregoing descriptions, it is to be understood that the end of the coil spring 9 adjacent the piston 6 may be rotatably mounted to the piston while the end of the spring adjacent the rear casing 4 is secured to the rear casing.

From the foregoing descriptions, it is to be appreciated that the present invention provide the following advantages:

Since the opposite ends of the coil spring are supported uniformly at a plurality of points around the axis, the possibility of the piston being offset toward magnetic poles on one side lateral of the piston axis is minimized, and even if piston should be offset toward on one side. rotation of the piston occasioned by the reciprocating movements thereof would prevent the sliding portions of the piston from being subjected to a circumferentially uneven wear. The useful life of the whole solenoid-operated reciprocating pump is substantially extended.

The above description is included to illustrate the preferred embodiments of the invention and is not meant to limit the scope of the invention. From the above discussion, many variations will be apparent to one skilled in the art that would yet be encompassed by the spirit and the scope of the invention.

We claim:

1. A solenoid-operated reciprocating pump comprising:

a casing means including a cylinder having a central axis;

a main shaft having a central axis and disposed in the casing means and secured at one end to the casing means with the central axis aligned with the central axis of said cylinder;

a piston having a piston head at a first end and rotatably and slidably fitted over said main shaft such that the piston head is disposed within said cylinder for axial motion;

a coil spring extending between a second end of said piston and said casing means to bias the piston in a first axial direction, one end of the coil spring being fixed to one of the piston or the casing means and the other end of the spring being rotatably supported on the other of the piston or the casing means by means of a spring retainer seated on a plurality of spherical balls which are in turn seated on said other of the piston or the casing means, said balls being positioned at equal distances radially from the central axis of the coil spring;

an armature radially extending from the outer periphery of said piston;

electromagnet means disposed around the longitudinal periphery of said piston to magnetically attract the armature and hence the piston in a second axial direction opposite from said first direction; and a pressure chamber defined in said cylinder by said piston head, said piston head and said cylinder having an inlet port and an associated suction valve for introducing fluid into said pressure chamber and an outlet port and an associated discharge valve for discharging fluid from the pressure chamber in response to the reciprocating movements of the piston, whereby said coil spring, in response to reciprocating movements of the piston, produces rotation of said piston to prevent circumferentially uneven wear on the piston.

2. The reciprocating pump of claim 1, wherein said one end of said coil spring is fixed to said piston and said other end of said coil spring is rotatably supported on said casing means.

3. The reciprocating pump of claim 1, wherein said one end of said coil spring is fixed to said casing means, and said other end of said coil spring is rotatably supported on said piston.

* * * * *